US010334997B2

(12) United States Patent
Yocom et al.

(10) Patent No.: US 10,334,997 B2
(45) Date of Patent: Jul. 2, 2019

(54) TOILET PAPER DISPENSER

(71) Applicants: David C. Yocom, Liberty Township, OH (US); Candice B. Yocom, Liberty Township, OH (US)

(72) Inventors: David C. Yocom, Liberty Township, OH (US); Candice B. Yocom, Liberty Township, OH (US)

(73) Assignee: HANDY TISSUE, LLC, Liberty Township, OH (US)

( * ) Notice: Subject to any disclaimer, the term of this patent is extended or adjusted under 35 U.S.C. 154(b) by 344 days.

(21) Appl. No.: 15/185,251

(22) Filed: Jun. 17, 2016

(65) Prior Publication Data

US 2017/0360265 A1 Dec. 21, 2017
US 2018/0177349 A9 Jun. 28, 2018

(51) Int. Cl.
*A47K 10/38* (2006.01)

(52) U.S. Cl.
CPC ..... *A47K 10/3836* (2013.01)

(58) Field of Classification Search
CPC ..... A47K 10/38; A47K 10/3836; A47K 2010/322; A47K 2010/389; F21V 33/004; F21V 23/0471; F21Y 2115/10; F16B 37/08; F16B 37/0814
See application file for complete search history.

(56) References Cited

U.S. PATENT DOCUMENTS 900,843 A 10/1908 Folberth
1,226,453 A 5/1917 Boyle
2,281,032 A * 4/1942 Galena ..... A47K 10/38 242/598.3
2,518,328 A 8/1950 Janonis
2,673,693 A 3/1954 Gray
2,739,840 A 3/1956 Anderson
3,228,618 A 1/1966 Bracken
3,475,067 A 10/1969 Girard
3,790,097 A * 2/1974 Wormly ..... A47K 10/38 242/560.2
3,797,336 A 3/1974 Howe
3,806,055 A 3/1974 Bauman
3,878,757 A * 4/1975 Puklus, Jr. ..... F16B 37/0814 411/433
5,624,025 A 4/1997 Hixon
5,868,345 A 2/1999 Beisser
7,281,277 B1 10/2007 Uchida
7,306,185 B1 12/2007 Miller
7,338,242 B2 3/2008 Ellis et al.
7,360,739 B1 4/2008 Horvat
(Continued)

*Primary Examiner* — William A. Rivera
(74) *Attorney, Agent, or Firm* — Ronald J. Richter; Hasse & Nesbitt LLC

(57) ABSTRACT

A toilet paper dispenser is disclosed in which the dispenser does not need to be mounted to the wall or placed on the floor. The dispenser is typically made of a one-piece construction that installs easily to any existing toilet by way of the mounting bolt for the toilet seat. The toilet paper dispenser adjustably rotates between an extended position alongside the toilet seat and a storage position behind the toilet seat and under the toilet tank. The inventive toilet paper dispenser can receive any size roll of toilet paper, and loads by sliding the roll over the open end of the dispenser. A modified bolt hole can allow the dispenser to be installed and secured in place on the mounting bolt without the need of a retaining nut.

9 Claims, 13 Drawing Sheets

(56) References Cited

U.S. PATENT DOCUMENTS

| | | | | |
|---|---|---|---|---|
| 8,231,318 | B2 | 7/2012 | Pitsch et al. | |
| 9,316,245 | B2 | 4/2016 | Dvorak | |
| 10,018,216 | B1 * | 7/2018 | Espinosa | F16B 37/0828 |
| 2008/0164277 | A1 | 7/2008 | Platt | |
| 2018/0263438 | A1 * | 9/2018 | Verchick | A47K 13/26 |

* cited by examiner

TOILET PAPER DISPENSER

CROSS-REFERENCE TO RELATED APPLICATIONS

This application is a continuation-in-part of U.S. application Ser. No. 15/083,642 filed Mar. 29, 2016, the disclosure of which is incorporated herein by reference in its entirety.

FIELD OF THE INVENTION

The present invention relates in general to toilet paper dispensers, and in particular to a one-piece toilet paper dispenser that can be mounted to a toilet bowl fixture.

BACKGROUND OF THE INVENTION

Most toilet paper dispensers are mounted on a wall found adjacent to a toilet. Typically these dispensers have two short "arms" which extend from the wall and support a mandrel between them. The toilet paper roll is rotatably supported by the mandrel and toilet paper is dispensed by rotating the toilet paper roll. However, occasionally there is no wall along, the side of the toilet, and even if there, is a wall along the side of a toilet, ceramic-type toilet paper dispensers are difficult for a homeowner to install on their own and typically require a lot of skill and expense to replace if they break. Further, when no side wall is present, toilet paper holders and dispensers are often placed in a position where it is difficult to access when sitting upon a toilet, thus requiring undue twisting, turning and reaching.

Solutions for difficult to install, difficult to reach, and/or distantly located toilet paper dispensers can be complex in construction and typically employ telescopic components, hinges, or, pivot joints. These devices generally permit only limited and awkward adjustment, and are unsuitable for a wide variety of situations. U.S. Pat. No. 7,306,185 to Miller, U.S. Pat. No. 3,228,618 to Bracken and U.S. Pat. No. 2,518,328 to Janonis each discloses a toilet paper holder for attachment to the toilet tank. These devices generally do not increase the ease with which the toilet roll can be accessed, and may present an undesirable obstruction. U.S. Pat. No. 1,226,453 to Boyle discloses a dispenser which is mounted onto a toilet seat. The dispenser generally comprises a couple of pieces of thick metal wire hinged together, with one end being attached to the toilet seat and the other end supporting a mandrel for receiving a toilet paper roll. Although this toilet paper dispenser can be positioned where a user can more easily access the toilet paper, it is unwieldy, does not retract so as to be out of the way when not in use, and projects above the level of the toilet seat creating a potentially undesirable obstruction.

Accordingly, there exists a need to provide a toilet paper dispenser which can be mounted without the benefit of an adjacent side wall extending alongside the toilet, yet which can be easily accessed for use and then placed into a storage position where it will not interfere with other uses of a restroom. It would also be advantageous to provide a toilet paper dispenser that is simple in construction, easy to install, and does not employ telescopic components, hinges or pivot joints.

SUMMARY OF THE INVENTION

The present invention provides a toilet paper dispenser which can be mounted beneath the rear deck of a toilet bowl fixture where it can easily be accessed, yet retracted quickly and easily to be stored behind the toilet bowl. It is a one-piece design that loads by sliding a toilet paper roll over the distal end of the dispenser. A plastic cover for protecting the loaded roll of toilet paper can be fitted to the dispenser, and the dispenser can include one or more compartments for a fragrance cartridge and/or a night light. The inventive dispenser can be sized to receive any size roll of toilet paper.

A first aspect of the invention relates to a toilet paper dispenser comprising: (a) a proximal horizontal segment for mounting to a toilet bowl fixture via a mounting bolt for a toilet seat; (b) a descending segment; and (c) a distal horizontal segment for receiving a roll of toilet paper, wherein segments (a)-(c) are made of a single piece construction.

A second aspect of the invention is a toilet paper dispenser which is rotatable for storage behind the toilet seat when not in use, the dispenser comprising: (a) a proximal horizontal segment for mounting to a toilet bowl fixture via a mounting bolt for a toilet seat, the proximal segment including a bolt hole for receiving the mounting bolt (b) a descending segment; (c) a distal horizontal segment for receiving a roll of toilet paper; and (d) a distal ascending segment for retaining the roll of toilet paper on the distal horizontal segment, wherein segments (a)-(d) are made of a single piece construction.

A third aspect of the invention relates to a method of providing easy access to a toilet paper roll, comprising: (a) mounting a toilet paper dispenser to a toilet seat via a mounting bolt for a toilet seat; (b) attaching a roll of toilet paper to the toilet paper dispenser; and (c) adjustably rotating the dispenser about the mounting bolt between: (i) an extended position, alongside the toilet seat for access to the roll of toilet paper; and (ii) a storage position behind the toilet seat when not in use.

A fourth aspect of the invention relates to a toilet paper dispenser that can be installed and secured in place on a mounting bolt without the need of a retaining nut, the dispenser comprising: (a) a proximal horizontal segment for mounting to a toilet bowl fixture via a mounting bolt of a toilet seat, the proximal horizontal segment including a bolt hole for receiving the mounting bolt, the bolt hole, comprising: (i) an upper ledge; (ii) a lower ledge; (iii) an upper transverse wall; (iv) a lower transverse wall; (v) an upper straight wall; and (vi) a lower straight wall, wherein the upper transverse wall and the lower transverse wall form a transverse cylinder centered about an axis A of the bolt hole, wherein the upper straight wall and a lower straight wall form a straight cylinder centered about an axis B of the bolt hole, wherein each ledge engages the screw threads of the mounting bolt when the mounting bolt is aligned with axis B, and wherein the bolt hole allows the dispenser to be installed and secured in place on the mounting bolt without the need of a retaining nut; (b) a descending segment; and (c) a distal horizontal segment for receiving a roll of toilet paper, wherein segments (a)-(c) are made of a single piece construction.

A fifth aspect of the invention relates to the following: In an apparatus to be secured to the threaded shaft of a mounting bolt, a bolt hole for securing the apparatus to the mounting bolt without the need of a retaining nut, the bolt hole comprising: (i) an upper ledge; (ii) a lower ledge; (iii) an upper transverse wall; (iv) a lower transverse wall; (v) an upper straight wall; and (vi) a lower straight wall, wherein the upper transverse wall and the lower transverse wall form a transverse cylinder centered about an axis A of the bolt hole, wherein the upper straight wall and a lower straight wall form a straight cylinder centered about an axis B of the bolt hole, wherein each ledge engages the screw threads of the mounting bolt when the mounting bolt is aligned with axis B, and wherein the bolt hole allows the apparatus to be installed and secured in place on the mounting bolt without the need of a retaining nut.

A sixth aspect of the invention relates to a method of mounting an apparatus to a mounting bolt without the need of a retaining nut, the apparatus including a bolt hole comprising an upper transverse wall and a lower transverse wall forming a transverse cylinder centered about an axis A of the bolt hole, an upper straight wall and a lower straight wall forming a straight cylinder centered about an axis B of the bolt hole, an upper ledge, and a lower ledge, the method comprising the steps of: (a) aligning the transverse cylinder of the bolt hole with the shaft of the mounting bolt; (b) sliding the transverse cylinder over the shaft of the mounting bolt so that the shaft travels along axis A of the transverse cylinder until the end of the bolt shaft exits the bolt hole; and (c) adjusting the apparatus to align the straight cylinder of the bolt hole with the shaft of the mounting bolt, thereby engaging the upper and lower ledges with the screw threads of the bolt shaft to secure the apparatus in place on the mounting bolt without the need of a retaining nut.

While the nature and advantages of the present invention will be more fully appreciated from the following drawings and detailed description, showing the contemplated novel combinations and elements as herein described, and more particularly defined by the appended claims, it is understood that changes in the precise embodiments of the present invention are meant to be included within the scope of the claims.

BRIEF DESCRIPTION OF THE DRAWINGS

The accompanying drawings illustrate embodiments of the invention and, together with a general description given above and the detailed description given below, serve to explain the principles of the invention.

DETAILED DESCRIPTION OF THE INVENTION

This invention provides an improved attachment means for a one-piece toilet paper dispenser. The dispenser is initially disclosed in the parent application for this invention, U.S. application Ser. No. 15/083,642 filed Mar. 29, 2016, the disclosure of which is incorporated herein by reference in its entirety. FIGS. 1-7 from the parent application are described in detail below, followed by the description of FIGS. 8-12 relating to the improvement. The improvement is to the bolt hole located in the proximal segment of the dispenser, and allows a user to quickly yet securely install the dispenser without the need of a retaining nut.

With reference to the drawings wherein like elements are designated by like numerals, FIGS. 1-7 generally illustrate a toilet paper dispenser 10 which can be mounted to the underside of the rear deck 50 of a toilet bowl fixture via the existing mounting bolt 20 for the toilet seat, where it can quickly and easily be rotated by a user between an extended "use" position (FIGS. 2, 3A) and a storage position (FIG. 3B) behind the toilet seat when not in use.

Figure 1:
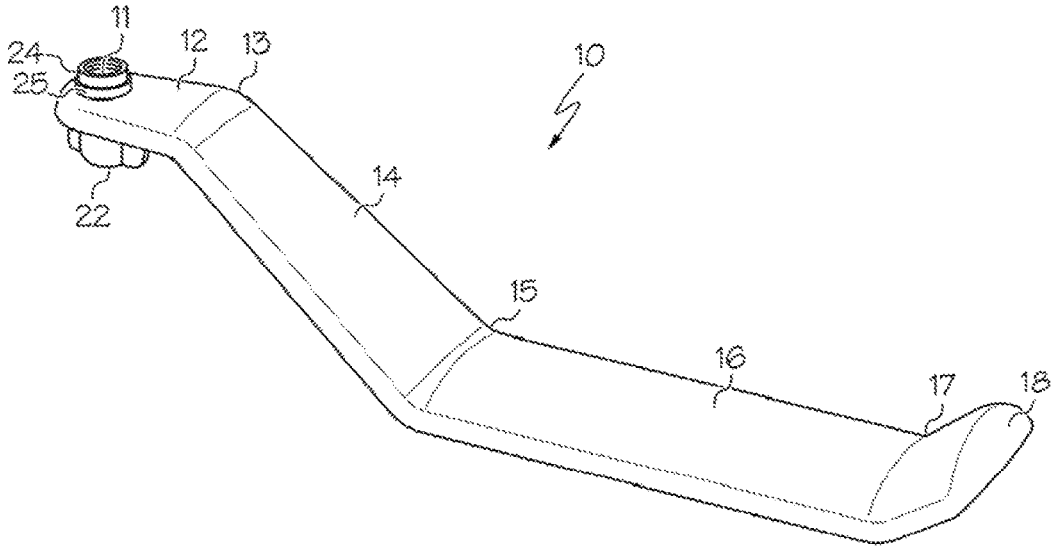
FIG. 1 is a perspective view of one embodiment of the one-piece toilet paper dispenser of the present invention.

FIG. 1 shows one embodiment of the one-piece toilet paper dispenser 10 having a proximal horizontal segment 12 including an eye or bolt hole 11 for receiving a mounting bolt for a toilet seat. A first bend 13 transitions the proximal segment 12 to a descending segment 14, which directs the dispenser in an outwards and downwards direction prior to transitioning via bend 15 to a distal horizontal segment 16. The distal horizontal segment 16 receives a roll of toilet paper, and a distal ascending segment 18 can be included to prevent the roll from falling off the distal horizontal segment 16 of the dispenser 10. Bends 13, 15 and 17 aid in transitioning between the various segments 12, 14, 16 and 18 of the dispenser, and all bends and segments are made of a single piece construction. A wing nut 22 which includes an extension or bushing 24 that fits within the inside circumference of the bolt hole 11 can be included for quick mounting.

Figure 2:
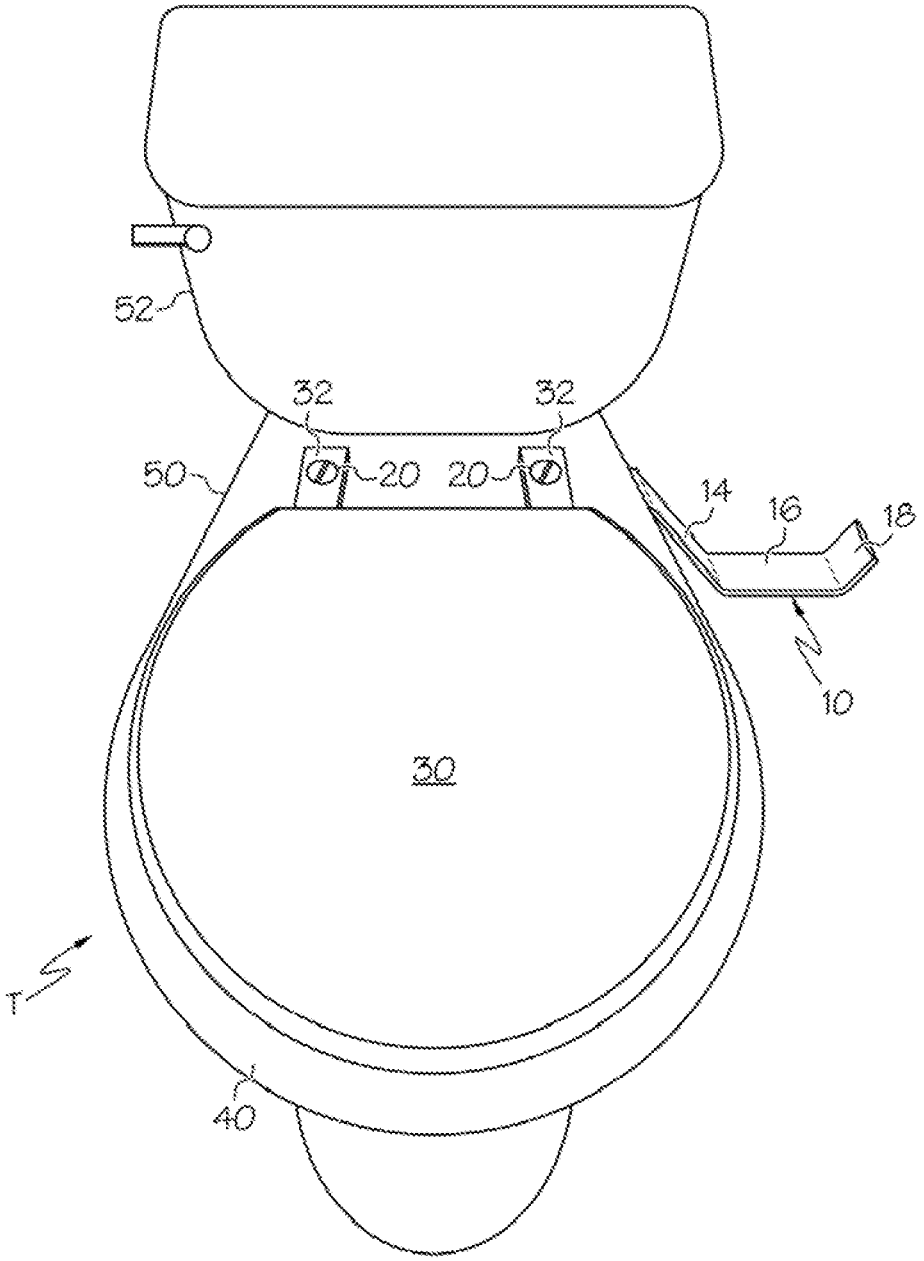
FIG. 2 is a top plan view of a typical sanitary toilet bowl fixture equipped with the dispenser of FIG. 1.
Figure 3A:
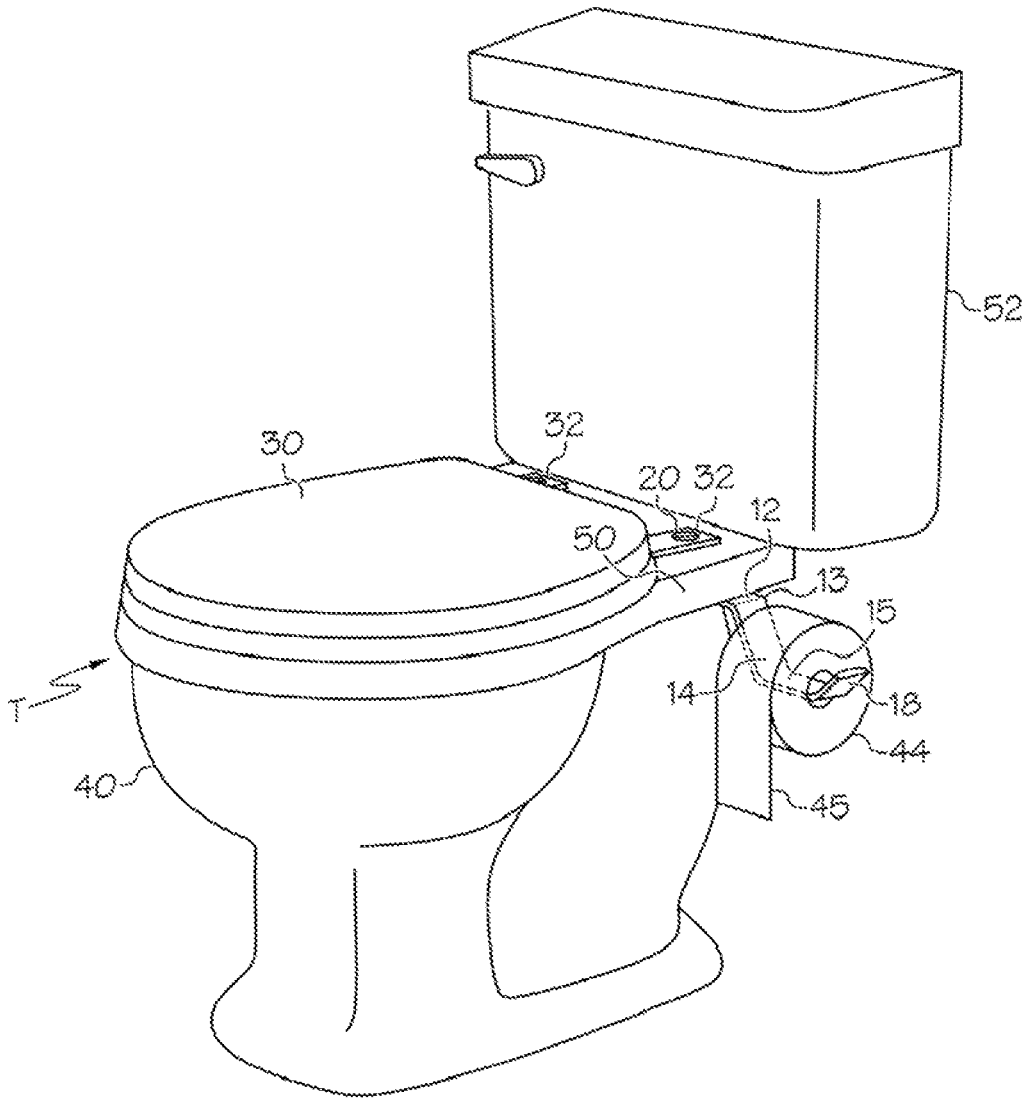
FIG. 3A is a perspective view of the dispenser of FIG. 1 attached to a toilet bowl fixture and rotated to an extended position.
Figure 3B:
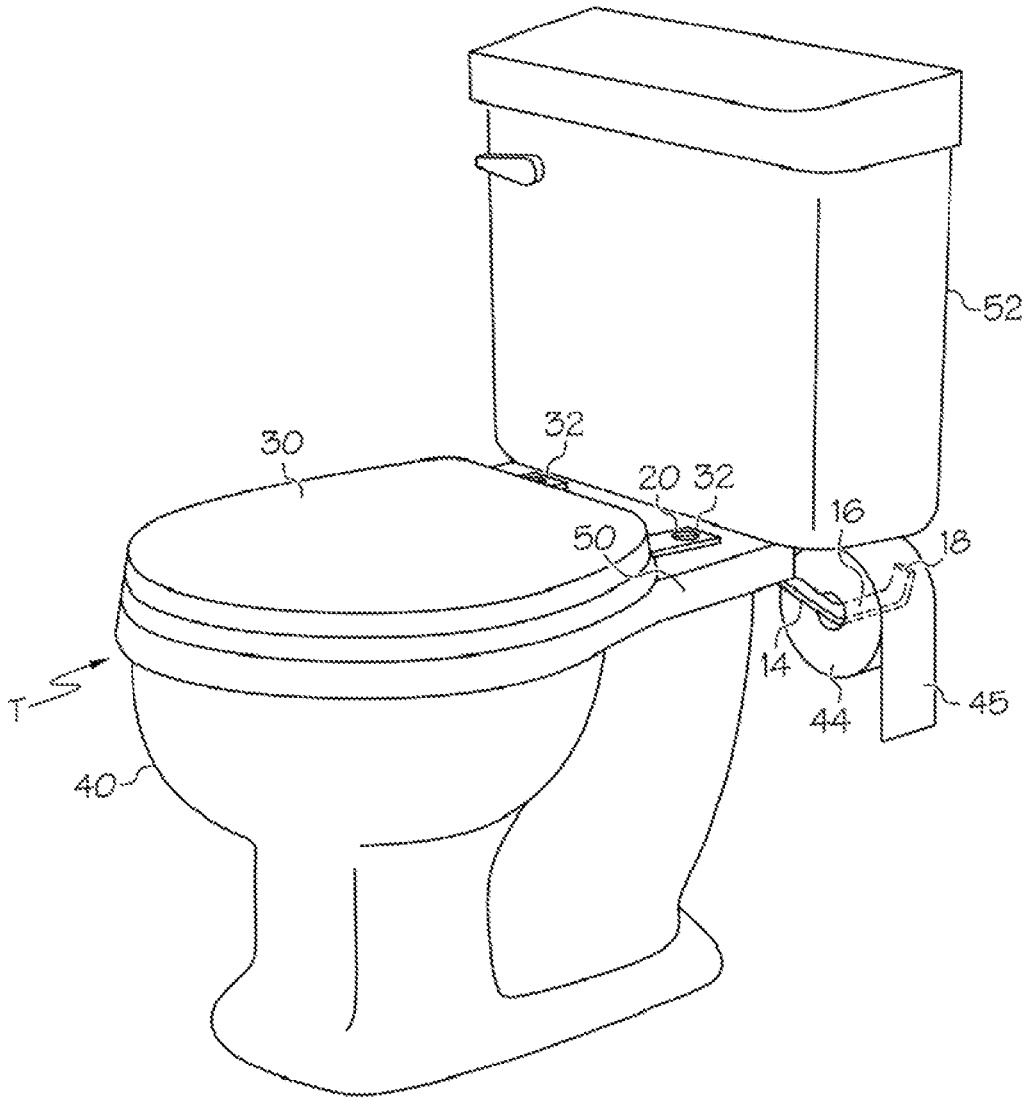
FIG. 3B shows the dispenser of FIG. 3A rotated to a storage position.

FIGS. 2, 3A and 3B illustrate a toilet bowl fixture designated by the letter T which includes a toilet bowl 40 having a rear deck 50 and a water tank 52. A toilet seat 30 is secured to the top of the bowl 40 by means of two mounting bolts 20. Two mounting plates 32 are hinged to the seat 30 and secured by the bolts 20 to the rear deck 50. The bolts 20 each pass through aligned bolt holes in a corresponding one of the mounting plates 32 and in the rear deck 50 of the toilet fixture T. Each mounting bolt 20 typically has a bolt head above the plate and a threaded shaft which passes through the aligned openings and engages a threaded retaining nut underneath the rear deck 50. Retaining nuts for toilet seat mounting bolts are well-known in the art, and typically mate With the mounting bolt 20 via threaded ridges that seal and tighten against the underside of deck 50 to secure the toilet plates 32 in place against the top side of the deck 50, and thus the seat 30 to the top side of the bowl 40.

The dispenser 10 can be quickly and easily mounted to the toilet bowl fixture T by first finding the shaft of one of the two mounting bolts 20 which have been previously installed, as described above, as it projects downward beneath the rear deck 50 of the toilet bowl 40. See FIG. 4. The user then aligns the bolt hole 11 of the proximal horizontal segment 12 with the threaded shaft of the bolt 20, and slides the proximal horizontal segment 12 up the shaft of the bolt 20, through the bolt hole 11. A threaded retaining nut, shown in FIGS. 1, 4 and 5 in the form of a threaded wing nut 22, is then threaded and tightened onto the mounting bolt 20 to secure the dispenser 10 beneath the rear deck 50 of the fixture T. The mounting bolt 20 and its associated retaining nut 26 typically do not need to be removed from the T in order to install the inventive dispenser 10. Since the threaded shaft of a conventional mounting bolt 20 is typically between 0.5 inches and 1.0 inches in length, a user can simply slide the dispenser 10 over the end of the bolt shaft as it projects downwardly beneath the toilet deck 50, and then screw a second retaining nut, such as wing nut 22 having and extension or bushing 24, onto the end of the bolt 20 to secure the dispenser 10 to the toilet fixture T.

If the user finds that the shaft of the mounting bolt 20 is not long enough to accommodate the thicknesses of: (1) the existing retaining nut securing the toilet seat bolt, (2) the proximal horizontal segment 12, and (3) a second retaining nut, then the dispenser can be Installed by first removing the existing retaining nut 26 prior to sliding the proximal horizontal segment 12 of the dispenser onto the shaft of the mounting bolt 20, and then securing the dispenser 10 with either of the first or second retaining nuts 26, 22 to securely affix the dispenser 10 to the underside of the rear deck 50 of the toilet bowl fixture T. The "second" retaining nut or wing nut 22 can be pre-manufactured and sold to go along with the dispenser 10. The bushing 24 is an extension of the wing nut 22, and sealingly fits between the shaft of the bolt 20 and the inside circumference of the bolt hole 11 so that the dispenser 10 is secured to yet rotatable about the axis of the mounting bolt 20.

Once the proximal horizontal segment 12 is secured by the mounting bolt 20 as described above, a user can adjustably rotate the one-piece dispenser 10 between an extended position alongside the toilet seat 30 as shown, e.g., in FIG. 2 and FIG. 3A, and a storage position behind the toilet seat, as shown in FIG. 3B. The dispenser's descending segment 14 makes a downward turn at bend 13, in order to offset the distal horizontal segment 16 laterally alongside the toilet seat 30 when in the extended position (see, e.g., FIG. 3A). The descending segment 14 proceeds for a certain length to bend 15, which levels out the one-piece dispenser 10 to a substantially horizontal position throughout the length of the distal horizontal segment 16. The distal horizontal segment 16 is intended to receive and secure a conventional roll 44 of toilet paper along its length, this length being sufficient to pass entirely through the hollow core of a conventional roll of toilet tissue 44. Further, segment 16 is typically of a width that allows the user to unroll the toilet roll 44 by pulling on the final/end tissue 45 of the roll 44, yet does not allow the roll 44 to unravel unassisted, i.e. the roll stops rotating when the user stops pulling end tissue 45. As best appreciated by viewing FIG. 1 and FIG. 7, the top surface and edges of the distal horizontal segment 16 can be rounded, to allow for easier rotation of the roll 44.

The toilet paper roll 44 is inserted onto the dispenser 10 by sliding the roll over the open end of the dispenser. The open end of the dispenser can include the distal ascending segment 18, bend 17, and the distal horizontal segment 16. The upward, turn of the dispenser at bend 17 is intended to help retain the toilet roll 44 in position and/or prevent the roll 44 from sliding off the end of the dispenser 10. Both the distal ascending segment 18 and the distal horizontal segment 16 are dimensioned to pass conveniently through the hollow core of the roll 44, and as noted above can have rounded top surfaces to assist with easy rotation of the roll about the dispenser. In one embodiment, the distal ascending segment 18 can be slightly wider than the inner circumference of a conventional toilet paper roll and/or have ridges extending outward that are wider than the circumference of the hollow core of the roll, such that the toilet paper roll 44 may have to be slightly pinched or compressed by the user to allow the hollow core of the roll 44 to fit over the distal end 18 during insertion.

As a non-limiting example, the distal ascending segment 18 can be between 1.7 inches and 1.85 inches wide, the distal horizontal segment 16 can be between 1.5 inches and 1.7 inches wide, and the descending segment 14 can be between 0.5 inches and 1.5 inches wide. The descending segment 14 typically tapers in width from bend 15 at its connection to the distal segment 16 back to bend 13 at the connection to the proximal horizontal segment 12. For example, the descending segment can be about 1.5 inches wide at bend 15 and taper to between about 0.75 inches to about 1.0 inches in width at bend 13. The proximal horizontal segment 12 can be between 0.5 inches and 0.75 inches wide, and can be rounded at its end to assist in rotation about the seat bolt 20. While these dimensions are preferred, it is noted that the dispenser 10 can also be manufactured such that all segments are of the same width.

The amount of vertical drop and horizontal clearance provided the descending segment 14 between bends 13 and 15 should be enough to allow the distal horizontal segment 16 to fit behind the toilet seat 30 and beneath the toilet tank 52 when in the storage position (see FIG. 3B). As a non-limiting example, this can be preferentially accomplished when the proximal horizontal segment 12 from its end to the bend 13 is between 1.0 inches and 2.0 inches in length, the angle of bends 13 and 15 are between 40 degrees and 50 degrees, the horizontal clearance length of the descending segment 14 from bend 13 to bend 15 is between 2.5 inches and 3.0 inches, and the vertical drop of the descending segment 14 from bend 13 to bend 15 is between 1.0 inches and 2.5 inches. The length of segment 16, which begins following bend 15, should be long enough to receive a conventional toilet paper roll, or between 4.0 inches and 5.0 inches; however, it can have dimensions to accept any size roll. As a non-limiting example, the length of the distal ascending segment 18, which begins following bend 17, can be between 0.5 inches and 1.0 inches in length, and the angle of bend 17 can be between zero (0) degrees and 50 degrees. Total length of the dispenser is generally between 8.5 inches and 11.0 inches.

The above non-limiting dimensions are generally sufficient to retain a roll of toilet paper and prevent it from sliding off of the end of the dispenser 10, while keeping the roll of toilet paper within easy reach of the user. Further, while bends 13 and 15 are preferably between 40 degrees and 50 degrees, and while bend 17 is preferably between zero (0) degrees and 50 degrees, all bends can be between zero (0) degrees and 90 degrees; however, the angles and dimensions listed above are most useful for nesting of multiple dispensers together for shipment.

Figure 4:
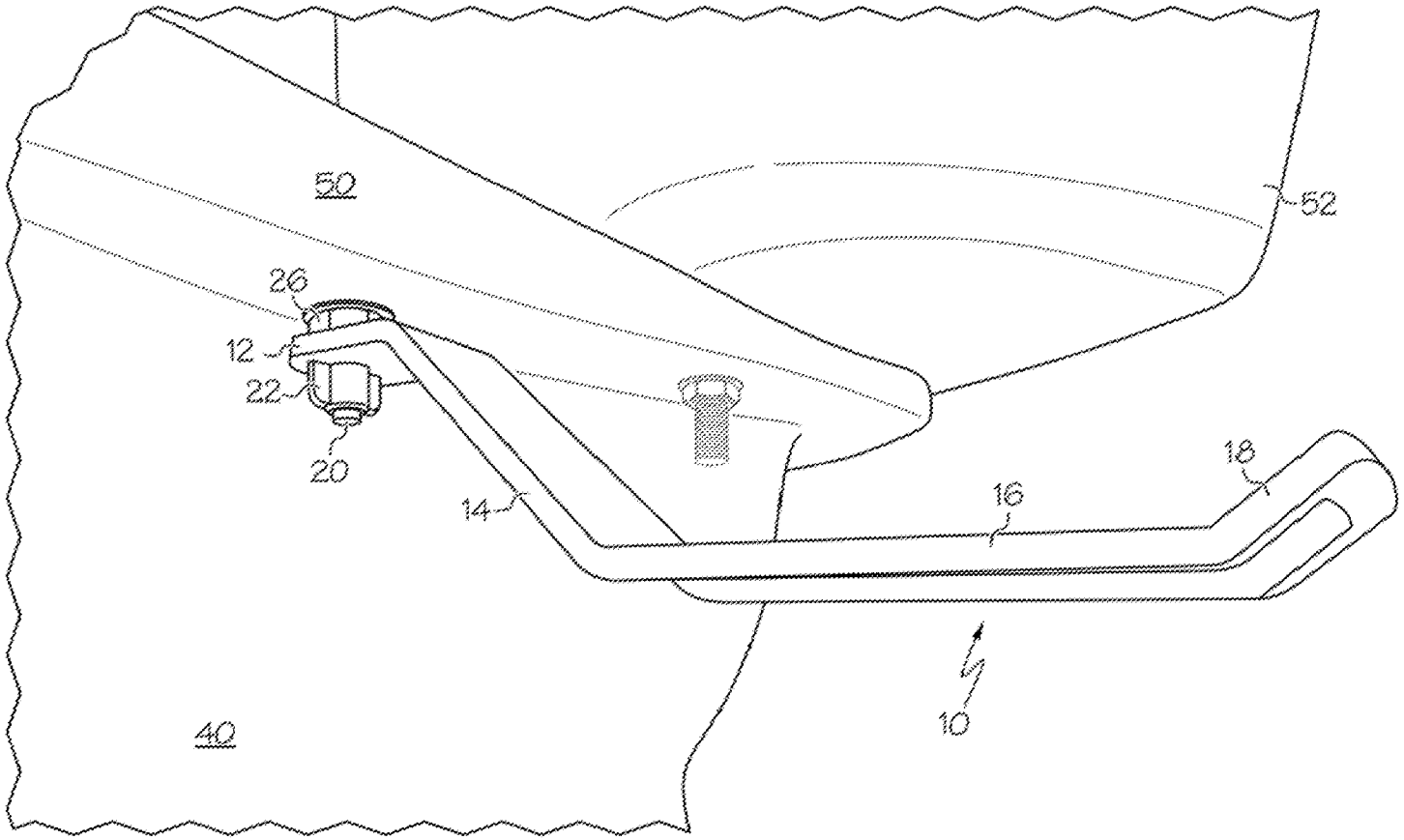
FIG. 4 is a perspective view showing how the dispenser is attached to the underside of a toilet seat fixture.
Figure 5:
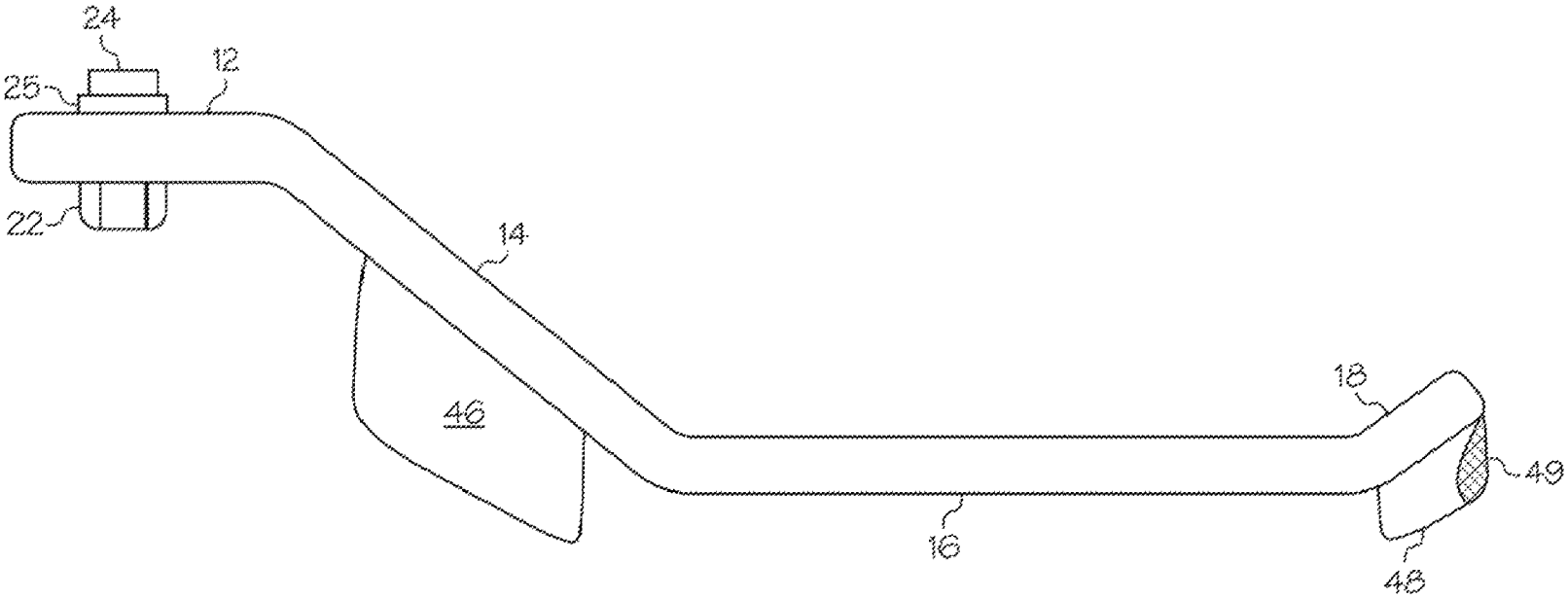
FIG. 5 is a side view of one embodiment of the inventive dispenser having an attached fragrance bar and night light compartment.
Figure 6:
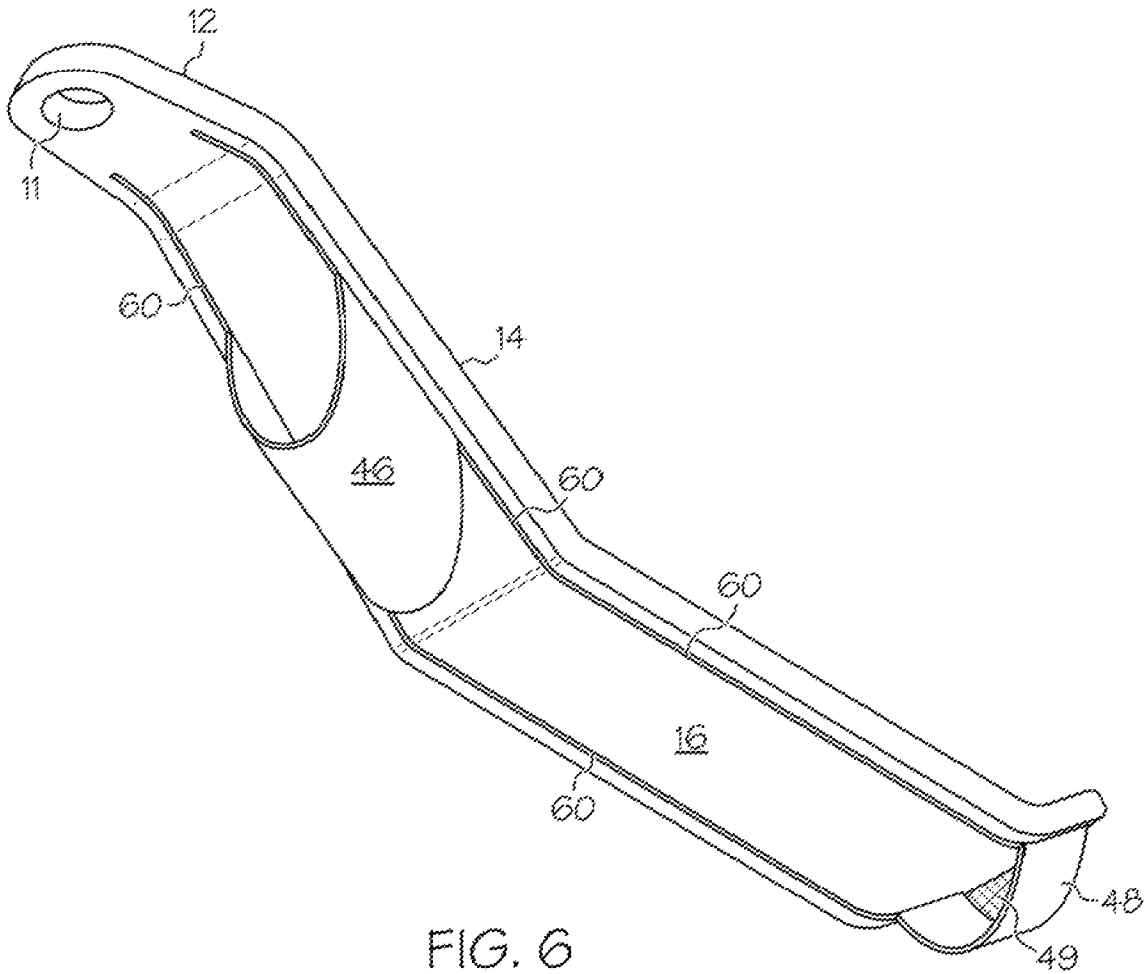
FIG. 6 is a perspective view of the underside of the dispenser in FIG. 5.

In the embodiment shown in FIGS. 5 and 6, concealed compartments 46, 48 located on the underside of the dispenser 10 can be, or can provide a location for, a fragrance cartridge 46 and/or a motion sensing LED battery-powered night light 48. FIG. 5 also illustrates an embodiment in which the proximal segment 12 includes a raised ridge 25 which is an extension of the edges of the bolt hole 11 (see also FIG. 1). This raised ridge 25 fits snugly with the bushing extension 24 of the threaded retaining nut or wing nut 22, and assists the dispenser to be smoothly and easily rotated between the extended position and the storage position. Though not necessary for installing the dispenser 10, because the existing retaining nut 26 (see FIG. 4) on the bolt 20 can be removed first and then replaced after sliding the dispenser on to the shaft of the mounting bolt 20, the wing nut 22 having the illustrated bushing extension 24 can be included and sold with the dispenser to allow the user to install the dispenser without having to remove the existing mounting bolt 26. The bushing 24 ensures a proper fit with the bolt hole 11 of the dispenser, guaranteeing a smooth rotation between use and storage positions.

FIG. 6 illustrates the underside of the dispenser 10, with the descending segment 14 including notches or tracks 60 for securing the fragrance bar 46 and night light 48. As shown, the fragrance bar 46 can be a curved deodorizing clip or hood 46 having edges that fit within the tracks 60 on the underside of the descending segment 14. In another embodiment (not shown), the fragrance bar 46 can be designed to clip to the sides of the descending segment 14. In another embodiment (not shown), a portion of, or even the entire dispenser 10 can be a fragrance bar. Fragrance clips and/or bars are known in the art and come in a variety of choices made of recyclable materials that release scents over an extended period of time.

FIGS. 5 and 6 also show a night light assembly 48 attached to the distal ascending segment 18 of the dispenser. The night light 48 can include a motion sensor which can be set to turn on when a user needs to use the bathroom at night. The night light can include a housing or enclosure 48, an electric current supply such as a battery, a motion sensor, and an electrically operated light source 49 such as a light emitting diode (LED) or incandescent light bulb. Such components are well-known in the art and are commercially available. For example, the housing 48 for the night light may be molded from plastic or other suitable material to hold the wiring and connections for one or more batteries, a motion sensor, and an LED light.

Wires or other electrical coupling may be included with the night light 48 to supply power from the batteries within the housing to the light, motion sensor and/or a control circuit. The motion sensor can include a switch, that opens the connection between the light and the motion sensor when it gets dark (so that the light is normally off), and closes the connection (i.e. turns the light on) upon sensing motion in its field of view. The sensor switch could be a thermal, an infrared, or a sonic activated type, so that a person disturbing the field of view will trigger the motion sensor. Appropriate threshold conditions for triggering the motion sensor may be established as is known in the art. Once activated, the light can also be controlled by a control circuit to stay lighted for a predetermined period of time before turning off.

Figure 7:
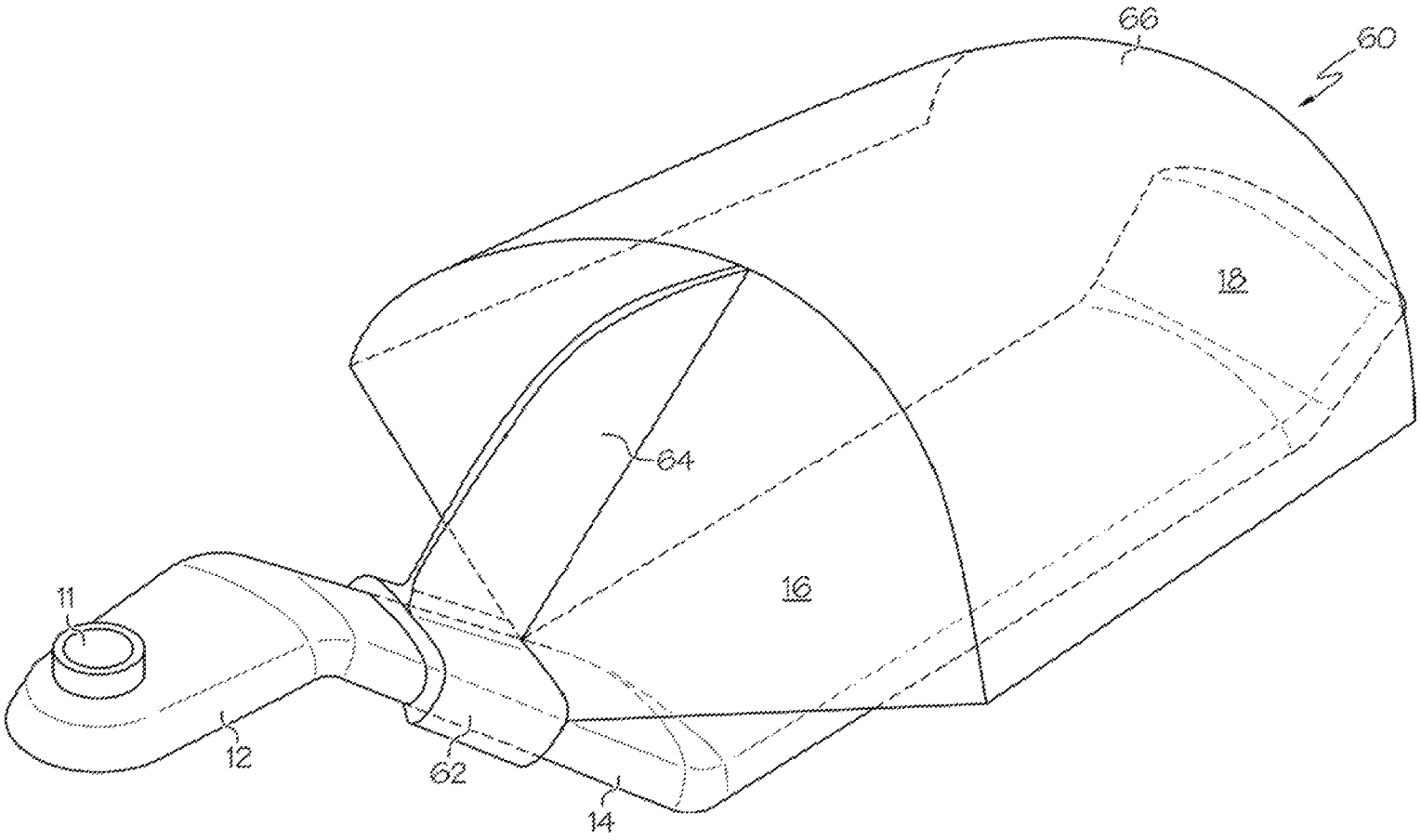
FIG. 7 is a perspective view of an optional plastic cover attached to the dispenser.

FIG. 7 illustrates an embodiment of the dispenser that includes an attachable cover 60. A fastener 62 of the cover 60 is shaped in the form of a "C" having open, curved ends. A user can hook a first curved end of the fastener 62 around the underside of the dispenser. The fastener 62 can then be rotated until the second end of the "C" hooks around the other underside of the dispenser. The user can then slide the fastener 62 down the tapered descending segment 14 until it becomes wedged into place or otherwise secured at the wider, distal portion of the descending segment 14, near bend 15. The curved ends of the fastener 62 can be designed to fit within the tracks 60 (shown in FIG. 6) on the underside of the descending segment 14. A large rib 64 projects from the fastener 62 and supports a hood portion 66 of the cover, which can envelope and protect a roll of toilet paper inserted onto the dispenser. The fastener 62, rib 64 and hood 66 are of a one-piece construction, and typically of the same material as the dispenser 10.

The dispenser 10 can be quickly and easily mounted to the toilet bowl fixture T by first finding the shaft of one of the two mounting bolts 20 which have been previously installed, as described above, as it projects downward beneath the rear deck 50 of the toilet bowl 40. See FIG. 4. The user then aligns the bolt hole 11 of the proximal horizontal segment 12 with the threaded shaft of the bolt 20, and slides the proximal horizontal segment 12 up the shaft of the bolt 20, through the bolt hole 11. A threaded retaining nut, shown in FIGS. 1, 4 and 5 in the form of a threaded wing nut 22, is then threaded and tightened onto the mounting bolt 20 to secure the dispenser 10 beneath the rear deck 50 of the fixture T. The mounting bolt 20 and its associated retaining nut 26 typically do not need to be removed from the fixture T in order to install the inventive dispenser 10. Since the threaded shaft of a conventional mounting bolt 20 is typically between 0.5 inches and 1.0 inches in length, a user can simply slide the dispenser 10 over the end of the bolt shaft as it projects downwardly beneath the toilet deck 50, and then screw a second retaining nut, such as wing nut 22 having and extension or bushing 24, onto the end of the bolt 20 to secure the dispenser 10 to the toilet fixture T.

Figure 8:
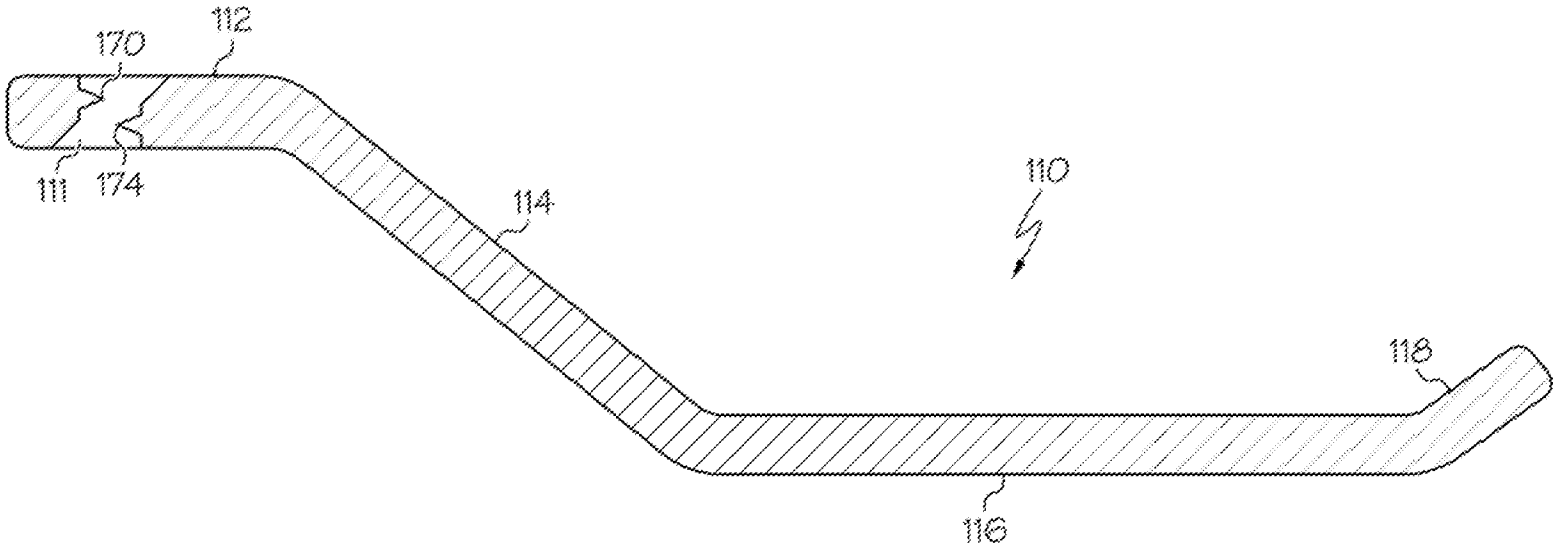
FIG. 8 is a side cross-sectional view of one embodiment of the inventive dispenser having a modified bolt hole.

FIG. 8 illustrates an embodiment 110 of the dispenser of the present invention which includes a modified bolt hole 111 for the proximal horizontal segment 112 that allows the dispenser 110 to be installed without the need of a second retaining nut (such as wing nut 22 seen in FIG. 4 and described above). An upper ledge 170 and a lower edge 174 can be seen projecting into the modified bolt hole 111. As described in more detail below, the dispenser 110 is secured by the contact made between the upper and lower ledges 170, 174 and the screw threads of the mounting bolt. The remainder of the dispenser 110 is similar to that shown in FIGS. 1-7, in which a first bend transitions the proximal segment 112 to a descending segment 114, which directs the dispenser in an outwards and downwards direction prior to transitioning to a distal horizontal segment 116. The distal horizontal segment 116 receives a roll of toilet paper, and a distal ascending segment 118 can be included to prevent the roll from falling off the dispenser.

Figure 9:
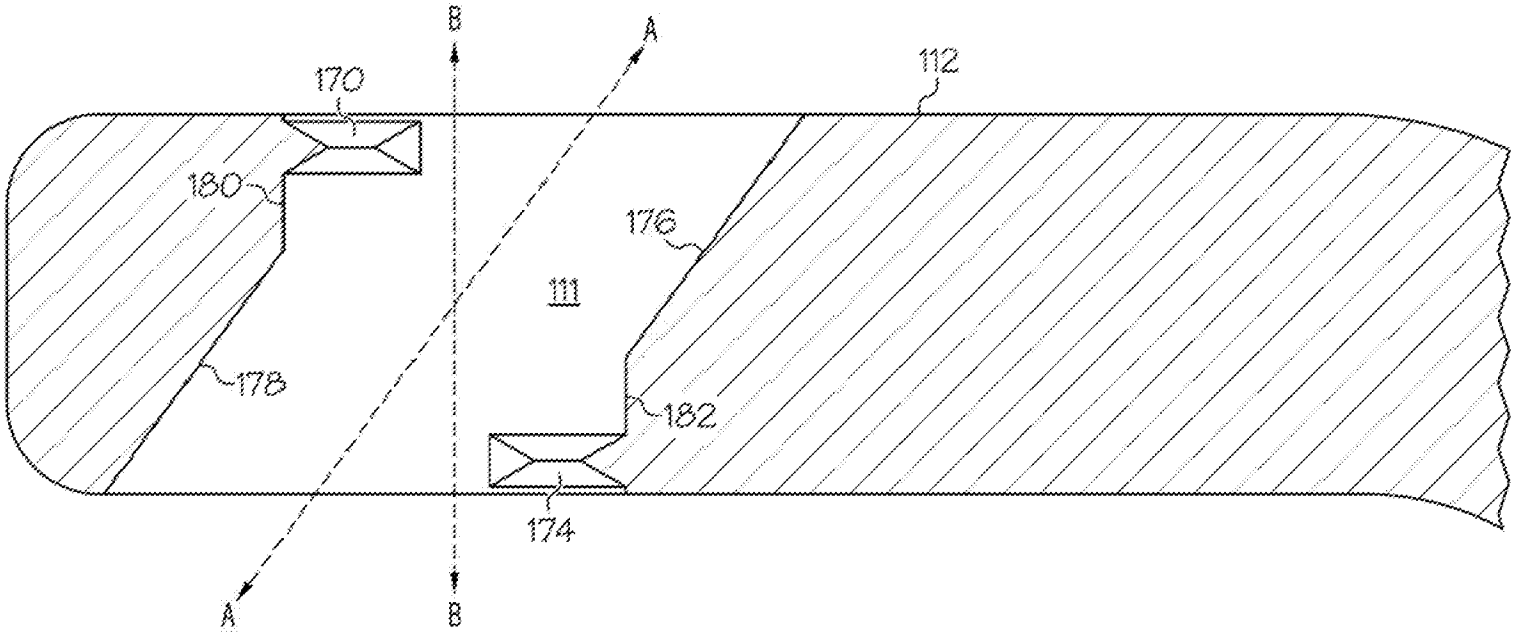
FIG. 9 is a blown up side view of the proximal dispenser of FIG. 8.

As can best be appreciated from viewing a close up view of the proximal horizontal segment 112 illustrated in FIG. 9, the upper ledge 170 and lower edge 174 can be seen within the modified bolt hole 111. An upper transverse wall 176 and a lower transverse wall 178 form a transverse cylinder centered about an axis A of the bolt hole 111. An upper straight wall 180 and a lower straight wall 182 form a straight cylinder centered about an axis B of the bolt hole 111. Axis B is substantially parallel to the straight walls 180, 182 and perpendicular to the proximal horizontal segment 112, and is the axis along which an inserted bolt will ultimately be seated after insertion. The transverse cylinder centered about axis A is not perpendicular to the proximal horizontal segment 112, but rather sits at an angle in relation to axis B. If axis B is considered to be perpendicular to the proximal horizontal segment 112 (i.e. straight up and down), then axis A is greater than zero degrees but less than ninety degrees in relation to axis B, and preferably between about 20 degrees to about 50 degrees in relation to axis B. The transverse cylinder, bounded by transverse walls 176 and 178 and centered about axis A, is useful for quickly and easily slipping the modified bolt hole 111 over the mounting bolt shaft. The bolt is easily movable between being positioned in the transverse cylinder to being positioned in the straight cylinder, that is, after insertion of the dispenser over the bolt shaft via the transverse cylinder, the dispenser can then be easily maneuvered by the user to align the bolt shaft into a position passing through the straight cylinder, i.e. bounded by straight walls 180 and 182 and centered about axis B. When this is done, the upper ledge 170 and the lower ledge 174 can catch, mate with engage, or otherwise be secured within the screw threads 123 of the bolt shaft, to securely lock the dispenser into position (see FIG. 11B) so that the dispenser cannot be removed if the user tries to pull the dispenser downward along the straight cylinder's path.

Figure 10A:
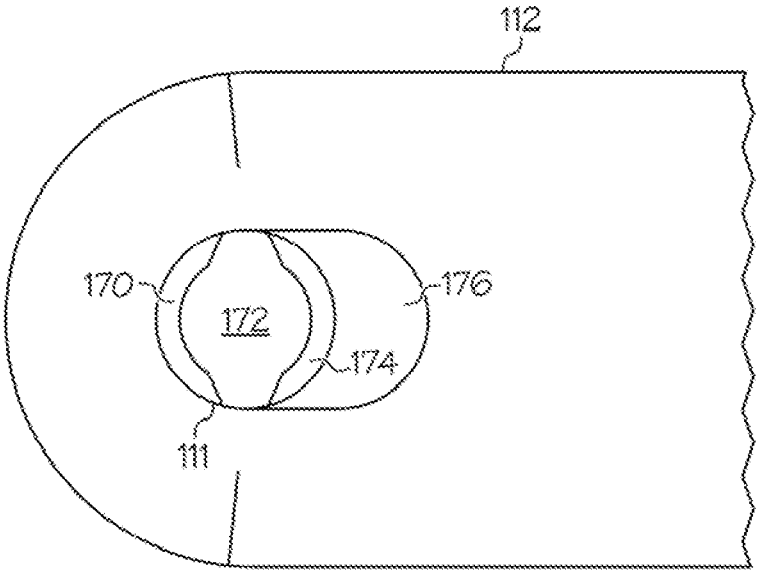
FIG. 10A is a top view of the proximal dispenser and bolt hole of FIG. 9.
Figure 10B:
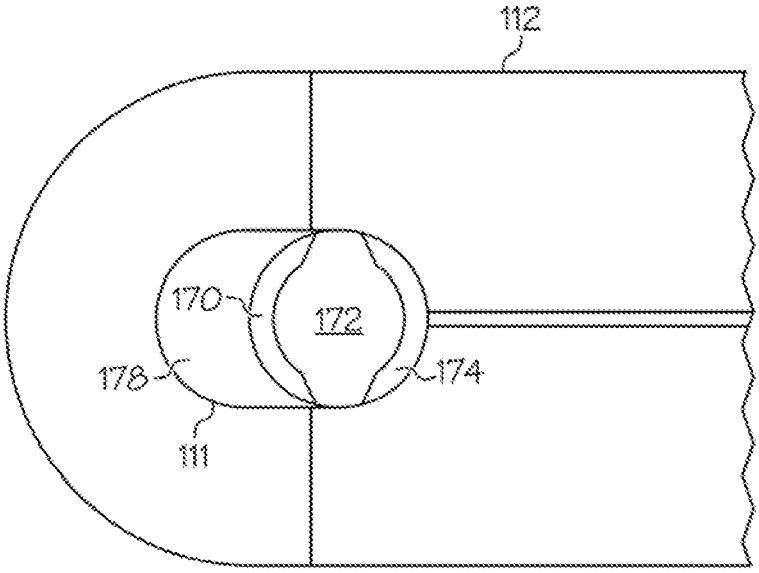
FIG. 10B is a bottom view of the proximal dispenser and bolt hole of FIG. 9.

FIG. 10A is a view looking down into the modified bolt hole 111 from above the top surface of the proximal horizontal segment 112 of the dispenser. It can be appreciated that, rather than having the circular cavity of a conventional bolt hole, the outer circumference of the inventive modified bolt hole 111 is generally oval-shaped. The upper ledge 170, opening 172, the lower ledge 174, and the upper transverse wall 176 can be seen within the bolt hole 111 in this view. Looking now at FIG. 10B, which illustrates a view of the oval shaped modified bolt hole 111 while looking up from beneath, the bottom surface of the proximal horizontal segment 112, the lower transverse wall 178, the upper ledge 170, the opening 172 and the lower ledge 174 are all visible. When the bolt is aligned with axis B of the bolt hole (see FIG. 9), the bolt passes through the opening 172 along axis B, and the dispenser 110 is secured to the bolt by the contact made between the upper and lower ledges 170, 174 and the threading of the bolt shaft.

It is noteworthy that the opening 172 is the actual "void" in the bolt hole 111, through which the mounting bolt shaft will pass. The term "bolt hole" as used herein does not refer to this void, but rather is a term that encompasses elements not present in the cavity of a conventional nut or other mounting means intended to be mounted to a bolt. These elements include the upper ledge 170, the lower ledge 174, the upper transverse wall 176, the lower transverse wall 178, the upper straight wall 180 and the lower straight wall 182.

Figure 11A:
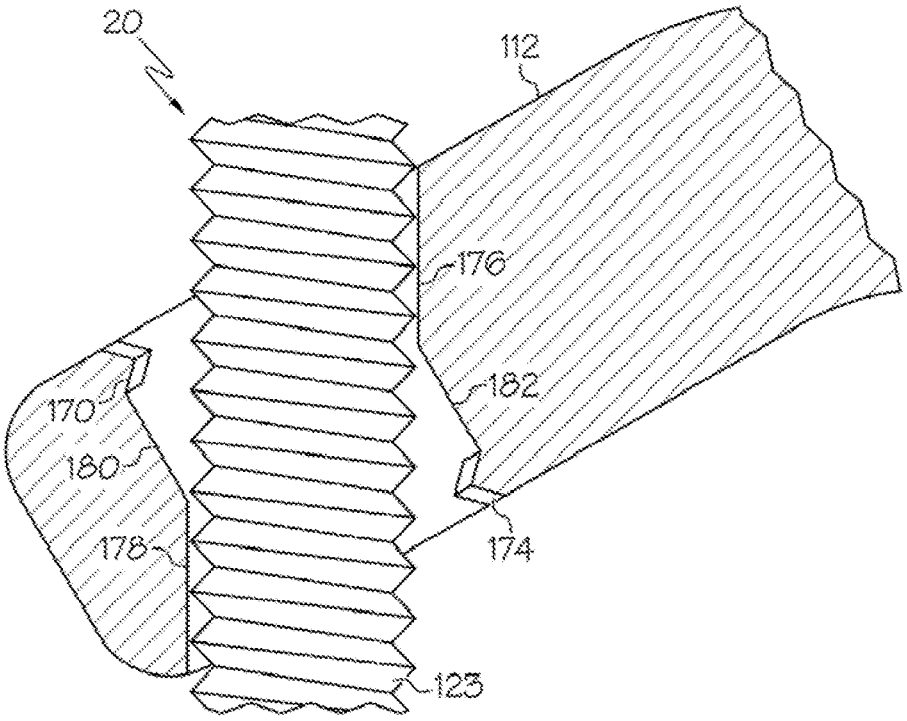
FIG. 11A is a side cross-sectional view showing a bolt in an installation and/or removal position, passing through the transverse, cylinder of the inventive bolt hole.
Figure 11B:
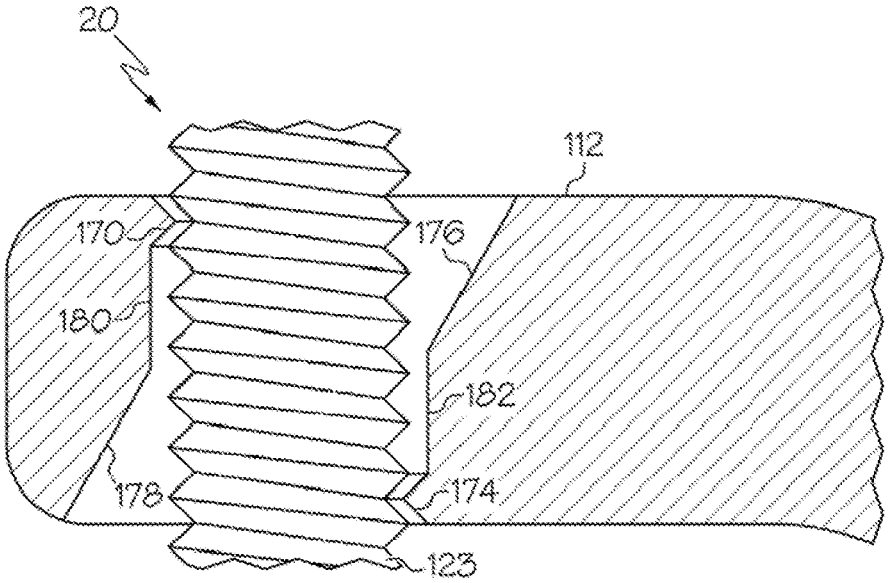
FIG. 11B is a side cross-sectional view showing the bolt of FIG. 11A in a locked position, sitting in the straight cylinder of the inventive bolt hole.

FIG. 11A illustrates a bolt 20 in an installation and/or removal position, passing through the transverse cylinder along axis A (see FIG. 9) of the inventive bolt hole 111. During installation or removal, the proximal horizontal segment 112 of the dispenser is tilted at an angle and slipped over the screw threads 123 of the bolt 20. By grasping the dispenser at a distal portion (e.g. the distal horizontal segment 116, see FIG. 8) and tilting it up at an angle as shown, the bolt can be caused to travel through the transverse cylinder along axis A of the bolt hole (111, see FIG. 9) in a direction parallel to the transverse walls 176, 178. This angled position allows the user to direct, slip or otherwise slide the proximal horizontal segment 112 of the dispenser up the shaft 123 of an existing seat bolt 20 at least until the end of the bolt shaft 123 passes through, exits, or otherwise extends beyond the cavity of the bolt hole. The user can then adjust the angle and/or otherwise level out the dispenser, so that the bolt shaft 123 is caused to travel through the straight cylinder along axis B of the bolt hole, i.e. in a direction parallel to the straight walls 180, 182. When this is done, the upper ledge 170 and the lower ledge 174 catch, engage and/or are otherwise secured by the screw threads of the shaft 123 to securely lock the dispenser 110 into position.

To remove the dispenser 110, a user can simply perform the reverse operation as described above, i.e. by grasping the level distal end of the dispenser and lifting up, thereby tilting the proximal horizontal segment 112 of the dispenser and causing the bolt shaft 123 to once again align with the transverse cylinder along axis A of the bolt hole 111. This causes the ledges 170 and 174 to disengage from the threads of the bolt shaft 123, so that the user can remove the dispenser from the bolt shaft along axis A of the bolt hole.

As with the earlier disclosed embodiments, the pre-existing toilet mounting bolt and its associated retaining nut typically do not need to be removed in order to install the inventive dispenser 110 having a modified bolt hole 111. The bolt hole 111 can simply be slipped onto the shaft 123 of the mounting bolt 20 along axis A. To secure the dispenser into position after slipping it onto the shaft, the angle of the bolt hole 111 is adjusted so that the bolt shaft aligns with the straight cylinder along axis B of the bolt hole, thus engaging the screw threads 123 of the bolt with the ledges 170, 174 and securing the dispenser in place on the bolt 20. The ledges 170, 174 are designed to engage, fit, mate, etc. with the screw threads 123 of the bolt in a manner similar to how the threads of a conventional nut mate with the screw threads of a conventional bolt; however, the ledges 170, 174 do not create a "pitch" because the ledges are in effect "single threads", one at one end of the bolt hole 111 and the other at the other end. The ledges 170, 174 thus mate with the bolt threads 123 but are discontinuous and do not complete a full turn about the bolt hole. Since the threaded shaft 123 of a conventional mounting bolt 20 is typically between 0.5 inches and 1.0 inches in length, a user can slip the dispenser 111 onto the bolt 20 until the shaft 123 has traversed the opening 172 of the bolt hole 111 far enough to allow both the upper and lower ledges 170, 174 to engage the screw threads of the bolt when the bolt shaft is caused to align with the straight cylinder along axis B.

Figure 12:
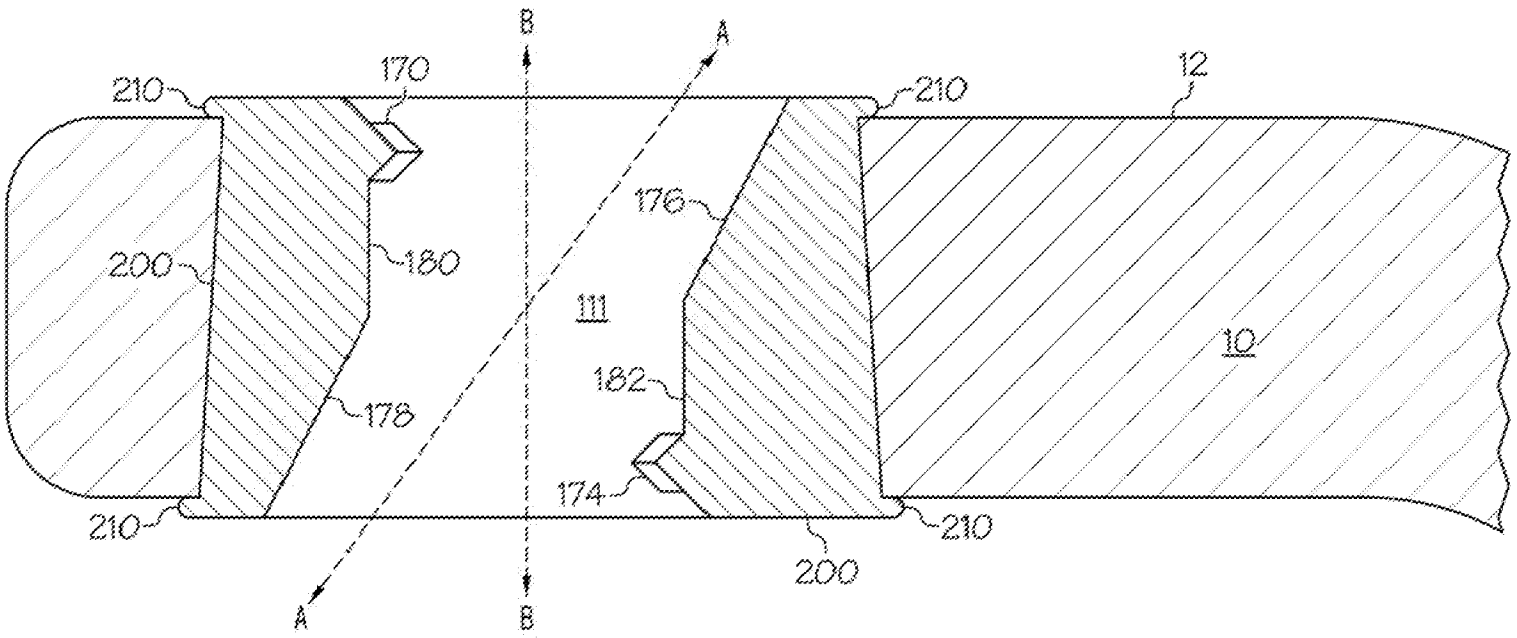
FIG. 12 is a side cross-sectional view of an insert having a modified bolt hole of FIG. 8 inserted into the conventional bolt hole of the dispenser of FIG. 1.

An embodiment of the invention shown in FIG. 12 is an insert 200 having the modified bolt hole 111 of FIG. 8. This insert 200 can be placed within the cavity of a conventional bolt hole, such as the bolt hole 11 of the dispenser embodiments shown in FIGS. 1-7. Like the bolt hole 111 of FIG. 8, the bolt hole 111 of the insert 200 also includes an upper ledge 170 and a lower edge 74, an upper transverse wall 176 and a lower transverse wall 178 forming a transverse cylinder centered about an axis A of the bolt hole 111, and an upper straight wall 180 and a lower straight wall 182 forming a straight cylinder centered about an axis B. When the insert is in place, the straight cylinder bounded by straight walls 180, 182 and centered about axis B is substantially perpendicular to the proximal horizontal segment 12 of the dispenser 10. The insert 200 can include axial flanges 210 which engage the end surface of the bolt hole and frictionally hold the insert in position within the bolt hole, or it can include any other means known in the art for securing an insert within a cavity.

In addition to placement within the conventional bolt hole 11 of the dispenser embodiments shown in FIGS. 1-7, the insert 200 illustrated in FIG. 12 can be useful for placement within any conventional bolt hole, such as the bolt hole of a conventional nut, or generally into the bolt hole of any device or apparatus to be secured to the threaded shaft of a mounting bolt. For example, should the user desire to mount a board, plank or other apparatus having a bolt hole to a pre-existing mounting bolt without the need of a retaining nut to secure it to the mounting bolt, this insert 200 can be used. Further, should the user encounter a bolt shaft diameter that is smaller than the inner diameter of the original bolt hole, this insert can be inserted and secured within the original bolt hole of the device in order to fit the device to the bolt shaft having the smaller diameter. In one embodiment of the invention, a dispenser kit or package can include the inventive dispenser of FIGS. 1-7 having a conventional bolt hole (11) along with a pack of 3 or more inserts that fit within the conventional bolt hole. Each insert can be configured to fit a different size of bolt thread diameter. The user can match the insert diameter to fit the thread diameter of the bolt, fit the selected insert 200 into place within the cavity of the original bolt hole, and then slip on and secure the device in place on the bolt shaft. The insert can be made of any materials known in the art for fitting a bolt shaft, such as stainless steel, high-strength steel, brass, aluminum and plastic.

In addition to providing an insert 200 including the inventive modified bolt hole, it can be appreciated by one of skill in the art that the modified bolt hole 111, illustrated in FIGS. 8-12 and described in detail above, can be pre-manufactured or incorporated into a conventional nut or other apparatus intended to be secured to the threaded shaft of a mounting bolt. Such a nut or other mounting apparatus could then be secured to the mounting bolt without the need of a retaining nut. More specifically, with the inventive bolt hole 111 described in detail above, a user can secure any apparatus intended to be secured to a mounting bolt, without having to also secure a retaining nut, by the following steps: 1) aligning the transverse cylinder (i.e. the cylinder bounded by transverse walls 176, 178 and aligned with axis A) of the bolt hole 111 with the shaft of the mounting bolt, 2) sliding the transverse cylinder over the shaft of the mounting bolt so that the end of the bolt shaft exits the bolt hole; and 3) adjusting the apparatus to align the straight cylinder (i.e. the cylinder bounded by straight walls 180, 182 and aligned with axis B) of the bolt hole 111 with the shaft of the mounting bolt, thereby engaging the upper and lower ledges 170, 174 of the bolt hole 111 with the screw threads 123 of the bolt shaft to secure the apparatus in place on the mounting bolt without the need of a retaining nut. The apparatus can be removed from the bolt shaft by the steps of: (re-)adjusting the apparatus to align the transverse cylinder of the bolt hole with the shaft of the mounting bolt, thereby causing the upper and lower ledges to disengage from the bolt shaft; and slipping the apparatus off of the bolt.

The toilet paper dispenser described in its various embodiments above, as well as the optional cover 60, wing nut 22, and compartments 46, 48 for a fragrance and/or night light, can be made of any rigid construction materials, such as plastics and metals, of sufficient strength and rigidity to withstand the modest forces required for their operation. Plastics can be formulated to be rigid and exhibit relatively low thermal conductivity compared to other materials. Useful plastics include styrene, acrylonitrile butadiene styrene (ABS), polypropylene, and polycarbonates. Useful metals include stainless steel, aluminum and polished brass, and can be formed from a metal sheet having a thickness such that it can be stamped and/or bended to form the desired configuration. Plastic components can be formed by any process known in the art, such as injection molding, stamping, or 3-dimensional printing. In one embodiment, the plastic can be infused with a fragrant material, such that the entire dispenser emits a fragrance.

It will be appreciated from the foregoing description that the claimed dispenser is simple in construction and can be quickly and easily installed in most conventional toilet bowl fixtures without modification to either the toilet fixture or the toilet seat. The installation does not require any special tools or skills, and is readily reversible without damage to the toilet bowl fixture so that the dispenser can be taken and reinstalled by someone moving to another residence. The dispenser may be easily moved and repositioned from one side of the toilet bowl fixture to the other to suit the convenience of the homeowner and/or to fit the particular toilet installation. It can also be easily moved out of the way when cleaning the bathroom, and can be used as storage for spare or backup rolls of toilet paper. The dispenser is of simple construction and its surfaces are generally accessible for cleaning.

While the present invention has been illustrated by the description of embodiments and examples thereof, it is not intended to restrict or in any way limit the scope of the appended claims to such detail. Additional advantages and modifications will be readily apparent to those skilled in the art. Accordingly, departures may be made from such details without departing from the scope of the invention.

What is claimed is:

1. A toilet paper dispenser which is rotatable for storage behind the toilet seat when not in use, the dispenser comprising:

a) a proximal horizontal segment for mounting to a toilet bowl fixture via a mounting bolt of a toilet seat, the proximal horizontal segment including a bolt hole for receiving the mounting bolt, the bolt hole comprising:
   i) an upper ledge;
   ii) a lower ledge;
   iii) an upper transverse wall;
   iv) a lower transverse wall;
   v) an upper straight wall; and
   vi) a lower straight wall, wherein the upper transverse wall and the lower transverse wall form a transverse cylinder centered about an axis A of the bolt hole, wherein the upper straight wall and the lower straight wall do not engage the screw threads of the mounting bolt and form a straight cylinder centered about an axis B of the bolt hole when the mounting bolt is aligned with axis B, wherein each ledge engages the screw threads of the mounting bolt when the mounting bolt is aligned with axis B, and wherein the bolt hole allows the dispenser to be installed and secured in place on the mounting bolt without the need of a retaining nut;

b) a descending segment; and c) a distal horizontal segment for receiving a roll of toilet paper, wherein the proximal horizontal segment, the descending segment, and the distal horizontal segment are made of a single piece construction.

2. The toilet paper dispenser of claim 1, further comprising:

d) a distal ascending segment for retaining the roll of toilet paper on the distal horizontal segment, wherein the proximal horizontal segment, the descending segment, the distal horizontal segment, and the distal ascending segment are made of a single piece construction.

3. The toilet paper dispenser of claim 1, wherein the descending segment is directed in an outwards and downwards direction prior to transitioning to the distal horizontal segment, and wherein the horizontal clearance length of the descending segment is between 2.5 inches and 3.0 inches, and the vertical drop of the descending segment is between 1.0 inches and 2.5 inches.

4. In an apparatus to be secured to the threaded shaft of a mounting bolt, a bolt hole for securing the apparatus to the mounting bolt without the need of a retaining nut, the bolt hole comprising:

i) an upper ledge;

ii) a lower ledge;

iii) an upper transverse wall;

iv) a lower transverse wall;

v) an upper straight wall; and vi) a lower straight wall, wherein the upper transverse wall and the lower transverse wall form a transverse cylinder centered about an axis A of the bolt hole, wherein the upper straight wall and the lower straight wall do not engage the screw threads of the mounting bolt and form a straight cylinder centered about an axis B of the bolt hole when the mounting bolt is aligned with axis B, wherein each ledge engages the screw threads of the mounting bolt when the mounting bolt is aligned with axis B, and wherein the bolt hole allows the apparatus to be installed and secured in place on the mounting bolt without the need of a retaining nut.

5. The bolt hole of claim 4, wherein the apparatus is an insert for placement within a cavity of a conventional bolt hole.

6. The bolt hole of claim 4, wherein the apparatus is pre-manufactured to include the bolt hole.

7. A method of mounting an apparatus to a mounting bolt without the need of a retaining nut, the apparatus including a bolt hole comprising an upper transverse wall and a lower transverse wall forming a transverse cylinder centered about an axis A of the bolt hole, an upper straight wall and a lower straight wall forming a straight cylinder centered about an axis B of the bolt hole, an upper ledge, and a lower ledge, the method comprising the steps of:

a) aligning axis A of the transverse cylinder of the bolt hole with the shaft of the mounting bolt;

b) sliding the transverse cylinder over the shaft of the mounting bolt so that the shaft travels along axis A of the transverse cylinder; and c) adjusting the apparatus to align axis B of the straight cylinder of the bolt hole with the shaft of the mounting bolt, thereby engaging the upper and lower ledges with the screw threads of the bolt shaft to secure the apparatus in place on the mounting bolt without the need of a retaining nut.

8. The method of claim 7, wherein the step of sliding the transverse cylinder over the shaft of the mounting bolt is continued at least until the end of the bolt shaft exits the bolt hole.

9. The method of claim 7, wherein after the apparatus has been mounted in place on the mounting bolt, the apparatus can be removed from the bolt shaft by the steps of:

d) adjusting the apparatus to align the transverse cylinder of the bolt hole with the shaft of the mounting bolt, thereby causing the upper and lower ledges to disengage from the bolt shaft; and e) slipping the apparatus off of the bolt shaft along axis A of the transverse cylinder.

* * * * *